United States Patent [19]

Bellafiore

[11] 4,291,203

[45] Sep. 22, 1981

[54] HEARING AID DEVICE

[76] Inventor: Gaspare Bellafiore, 58 Stevens Rd., Cranston, R.I. 02910

[21] Appl. No.: 74,425

[22] Filed: Sep. 11, 1979

[51] Int. Cl.[3] ..... H04R 25/00

[52] U.S. Cl. ..... 179/107 E; 179/107 H

[58] Field of Search ..... 179/107 R, 107 BC, 107 E, 179/107 H, 107 S

[56] References Cited

U.S. PATENT DOCUMENTS

| | | | |
|---|---|---|---|
| 3,098,127 | 7/1963 | Huth | 179/107 H |
| 3,676,611 | 7/1972 | Stephens | 179/107 E |

FOREIGN PATENT DOCUMENTS

| | | | |
|---|---|---|---|
| 1132973 | 7/1962 | Fed. Rep. of Germany | 179/107 E |
| 52-22403 | 2/1977 | Japan | 179/107 E |

*Primary Examiner*—Thomas A. Robinson

*Attorney, Agent, or Firm*—Salter & Michaelson

[57] ABSTRACT

A hearing aid device including a microphone that is located in the auditory canal of the user's ear and that is retained in position therein by insertion into a molded ear plug that is received in the auditory canal, the microphone being completely embedded in the ear plug so that only a sound inlet portion thereof projects outwardly therefrom. With the microphone located in the auditory canal the concha portion of the user's ear functions in the usual manner as a sound collector for the microphone. A sound tube also extends through the ear plug for communication with the auditory canal of the user's ear and further communicates with a transducer that electronically translates the sound into electrical impulses that are amplified and retranslated into amplified sound for transmission through the sound tube, the interior of the sound tube being free and unobstructed to provide for fidelity of sound as transferred through the sound tube to the auditory canal.

2 Claims, 3 Drawing Figures

HEARING AID DEVICE

BACKGROUND OF THE INVENTION

The present invention relates to a hearing aid device and more particularly to the kind of device that includes a microphone that is located in the user's auditory canal so that the concha portion of the user's ear acts as a sound collector therefor.

The use of miniature hearing aids has been known heretofore, one such hearing aid being disclosed in the U.S. patent to HUTH, U.S. Pat. No. 3,098,127. The HUTH hearing aid includes a microphone that is inserted into a cavity as formed in an ear plug molded from a plastic material. The microphone is electrically interconnected to an amplifier that amplifies the sounds as received by the microphone and transmits the amplified sound to a speaker. Connected to the speaker and also extending into the ear plug is a sound tube that transfers the amplified sound from the speaker to the auditory canal of the user. In the HUTH hearing aid, the electrical wiring that joins the microphone and amplifier extends through the sound tube for concealment therein.

Although the hearing aid as disclosed in the patent to HUTH, U.S. Pat. No. 3,098,127, satisfied the purpose of concealing the wiring from the microphone to the amplifier and was sufficiently miniaturized to essentially conceal the hearing aid in the ear of the user, the microphone was not located in the auditory canal of the user's ear, wherein the concha portion of the ear could not function as an efficient sound collector. The location of the wiring in the sound tube that extended from the microphone to the amplifier in the HUTH device also interfered with sound transmission and adversely affected the quality of sound as transmitted to the auditory canal of the ear of the user.

SUMMARY OF THE INVENTION

The present invention relates to a miniaturized hearing aid device that includes a microphone that is located in the auditory canal of the user's ear. The hearing aid device further includes an ear plug in which the microphone is embedded, the ear plug being inserted in the user's auditory canal for locating the microphone therein. The microphone is defined by a body portion that is concealed in the ear plug and a sound inlet portion that is exposed to sound and is substantially enveloped by the concha portion of the user's ear, the concha portion acting as a focal point for collecting sound for the sound inlet. A housing for the miniaturized components of the device is mounted on the ear of the user and has an amplifier located therein, the amplifier and microphone being electrically interconnected, wherein sound waves received by said microphone are electrically transmitted to the amplifier for amplification thereof. A transducer is located in the housing and is electrically connected to the amplifier. A sound tube for transmitting the amplified sound to the auditory canal is provided and has one end which extends through the ear plug for communication with the auditory canal and another end which projects into the housing of the device for communication with the transducer, wherein the amplified sound received from the microphone is transmitted by the transducer and sound tube to the auditory canal of the user. The interior of the sound tube is competely free and unobstructed by wiring or the like to insure for fidelity of the amplified sound that is transferred through the sound tube to the auditory canal of the user.

Accordingly, it is an object of the invention to provide a hearing aid device having a microphone that is located in the user's auditory canal, the microphone being completely embedded in an ear plug that is inserted into the auditory canal and having a sound inlet portion that is exposed to transmitted sound waves, the concha portion of the ear acting as a sound collector for the microphone; the hearing aid device further including a sound tube for transmitting amplified sound to the auditory canal of the user, wherein the sound tube is free and unobstructed to provide for fidelity of sound as transferred therethrough.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
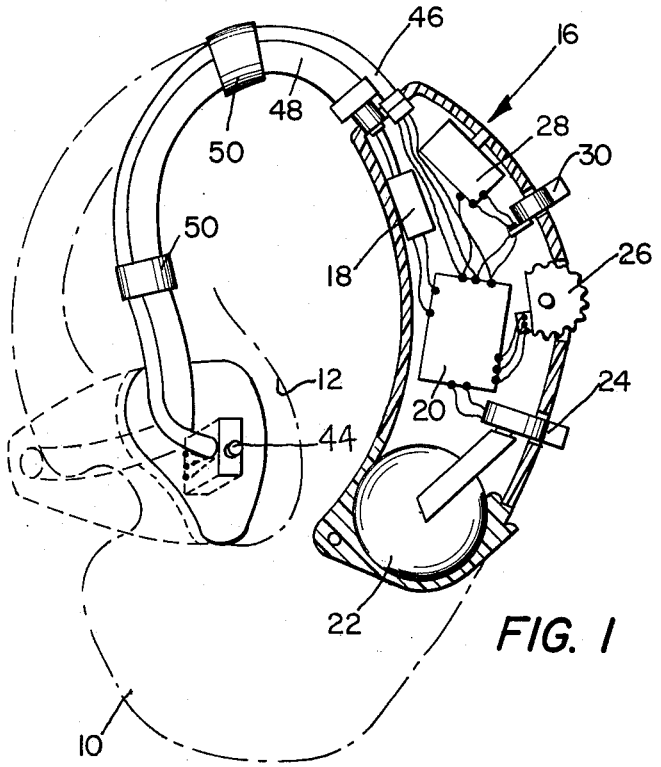
FIG. 1 is a sectional view of the housing of the hearing aid device embodied in the present invention, the components of the device being shown in elevation and the device being illustrated in the position as mounted on the ear of the user.

Referring now to the drawing, and particularly to FIG. 1, a first form of the hearing aid device embodied in the present invention is located on the ear of the user. As illustrated in FIG. 1, the ear of the user is shown in phantom and is indicated at 10, the ear 10 including a concha portion 12 that surrounds the interior auditory canal of the user's ear.

Figure 2:
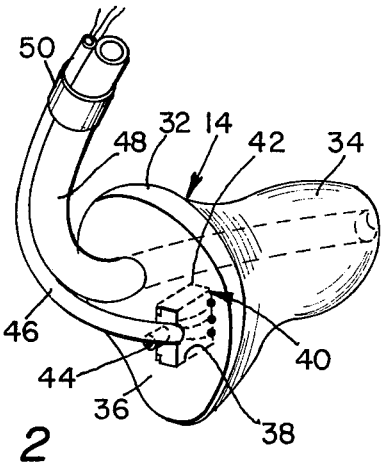
FIG. 2 is a perspective view of the ear plug of the hearing aid device embodied herein, showing the location of the microphone and sound tube as embedded therein.

The hearing aid device of the subject invention includes an ear plug generally indicated at 14 which is shown more clearly in FIG. 2, and a housing generally indicated at 16 in which the electrical components of the device are located. The housing 16 is contoured to fit behind the ear 10 and is essentially concealed in this position as is well known in the use of conventional hearing aid devices.

The instrumentation or components of the hearing aid device as located in the housing 16 are conventional in construction and function, and as shown in FIG. 1 include a transducer 18 that is electrically connected to an amplifier 20. A battery 22 supplies the power to the amplifier 20 and is controlled by an on-off switch 24 that projects through the wall of the housing 16 for access by the user. A volume control rheostat 26 that has an adjustment wheel that projects outwardly of the housing wall is electrically connected to the amplifier 20 for controlling the volume of the device. A conventional internal microphone 28 is located within the housing 16 and is controlled by a microphone switch 30. All of the just described components or instruments as located in the housing 16 are conventional equipment as normally utilized in a hearing aid device, and are utilized in combination with the unique features that define the subject invention.

Referring now to FIG. 2, the ear plug 14 is more clearly illustrated, and is normally molded of a suitable pliable plastic material in accordance with the contour of the user's ear to permit proper retention thereof in the auditory canal of the user's ear. The ear plug 14 includes a head portion 32 to which is joined a reduced, outwardly extending stem portion 34. The head portion 32 includes an outer face 36 in which an interior recess is formed that is shaped for receiving an external microphone generally indicated at 40. The external microphone 40 includes a body portion 42 and a sound inlet portion 44 that projects outwardly of the body portion 42. The body portion 42 of the external microphone 40 projects into the recess 38 so as to be completely embedded in the ear plug 14 and is located in the auditory canal of the user's ear so that only the sound inlet portion 44 projects outwardly of the face 36 for intercepting the sound waves that are directed toward the concha portion of the ear of the user. Joined to the body portion 42 of the external microphone 40 is a small diameter conduit 46 through which the electrical wiring that is connected to the body portion 42 of the microphone extends. As shown in FIG. 1, the other end of the wire conduit 46 is received in the end of housing 16 that is located adjacent to the transducer 18, the electrical wiring joined to the external microphone 40 being electrically interconnected to the amplifier 20 at the point of connection with the wiring of the internal microphone 28.

Projecting interiorly of the ear plug 14 through a passage formed therein and extending through the face 36 to substantially the end of the stem portion 34 is one end of a sound tube 48, the other end of the sound tube 48 projecting interiorly of the housing 16 adjacent to the wire conduit 46. Both the wire conduit 46 and the sound tube 48 are secured in appropriate openings as formed in the end of the housing 16 by suitable fastening means. As further shown in FIG. 1, spaced plastic straps 50 are wrapped around the conduit 46 and tube 48 along the lengths thereof so as to bind the conduit and tube together to provide a compact assembly and to prevent movement of the wiring within the conduit 46.

It is seen that the sound tube 48 which is directly connected to the transducer 18 and which communicates with the auditory canal of the user's ear receives the amplified sound as transmitted to the amplifier 20 from either or both the microphone 28 or the microphone 40 for transmitting the amplified sound to the auditory canal of the ear of the user. It is further seen that the interior of the sound tube 48 is free and unobstructed, which insures the quality of the sound as transferred therethrough to the auditory canal. It is also seen that by embedding the external microphone 40 in the recess 38 of the ear plug 14 so that it is effectively located in the auditory canal the adjacent concha portion 12 acts as an efficient sound collector therefor and insures that the sound inlet 44 of the external microphone 40 that extends outwardly of the face 36 of the ear plug efficiently receives the sound waves that are directed thereto. Further, the embedding of the microphone 40 into the ear plug will avoid the possibility of dislodging of the external microphone from the ear plug during use of the hearing aid device.

The internal microphone 28 is used either independently of the external microphone 40 or concurrently therewith. By using the internal microphone 28 concurrently with the external microphone 40, the user will have the benefit of detecting sound emanating from all directions and thus the device is universal in its application as a sound receiving and amplifying unit. However, if the use of the internal microphone 30 is disturbing to the user, it may be switched to an off position by the microphone switch 30. It is also seen that the entire device may be switched off by actuation of the on-off switch 24.

Figure 3:
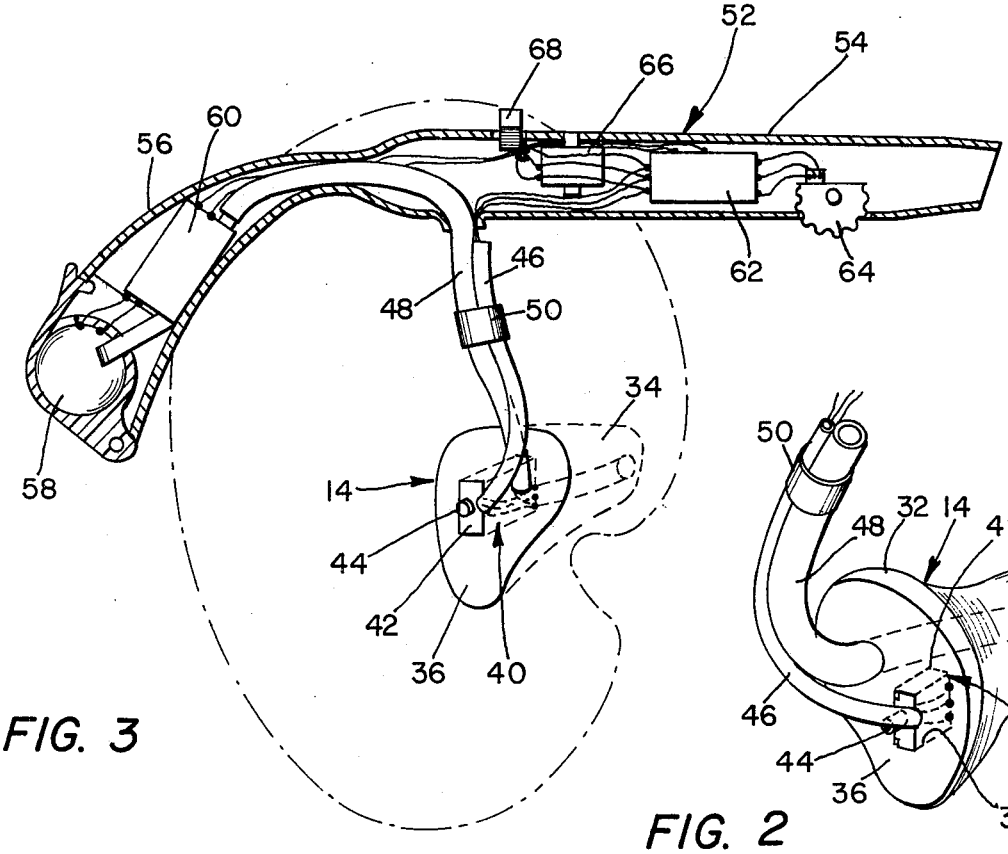
FIG. 3 is a sectional view of a modified form of the hearing aid device as used with a spectacle temple bar as mounted on the ear of the user.

Referring now to FIG. 3, a modified form of the invention is illustrated, wherein the device is used with spectacles, and in this form of the invention, the ear plug 14 including the external microphone 40, the conduit 46 and sound tube 48 are all constructed essentially the same as described above in connection with FIGS. 1 and 2. However, in order to accommodate the electrical components in a pair of spectacles, the components are located in a temple bar of the spectacles generally indicated at 52 that is pivotally joined to the spectacle frame in the conventional manner. The temple bar 52 includes a hollow body portion 54 to which is integrally joined a hollow ear piece 56. Located in the ear piece 56 is a battery 58 and a transducer 60. The sound tube 48 extends through an opening in the underside of the temple bar body portion 54 and is connected to the transducer 60 and receives amplified sound therefrom as will be described. Located in the body portion 54 of the temple bar 52 is an amplifier 62 that is electrically connected to the external microphone 40 through electrical wiring that extends through the conduit 46. A volume control rheostat switch 64 projects outwardly through an opening in the underside of the body portion 54 of the temple bar 52 and is electrically connected to the amplifier 62 for the control thereof, the amplifier 62 also being electrically interconnected to the transducer 60 through appropriate wiring. An internal microphone 66 is also electrically connected to the amplifier 62 and includes a sound inlet portion that has access externally of the temple bar through a small opening in the upper portion thereof. A switch 68 projects outwardly of the temple bar 52 and controls the operation of the internal microphone 66, while the volume control switch 64 may also be used as an off-on switch for hearing aid device shown in FIG. 3.

As previously described in connection with FIG. 1, the ear plug is located in the auditory canal of the user's ear, the stem portion 34 projecting inwardly thereof to provide communication between the sound tube 48 and the auditory canal of the user's ear. The outer surface 36 of the head portion of the ear plug 14 faces outwardly and is surrounded by the concha portion 12, the external microphone 40 being embedded within the ear plug and thus being located in the auditory canal so that only the sound inlet portion 44 projects outwardly of the surface 36. The concha portion thus acts as a collector for directing sound to the focal point thereof at which point the sound inlet portion 44 of the external microphone is located.

In use, the spectacles in which the device is mounted are located in the usual manner on the face of the user, the internal microphone 66 as located in the temple bar 52 and the external microphone 40 as located in the auditory canal of the user's ear being operable to effectively transmit sound to the amplifier 62 from where it is amplified and transmitted to the auditory canal of the user's ear by way of transducer 60 and sound tube 48.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hearing aid device, comprising an ear plug for insertion into the auditory canal of the user's ear, a microphone having a body portion and sound inlet portion that projects outwardly of said body portion, the body portion of said microphone being completely embedded in said ear plug so as to be located in said auditory canal and said sound inlet portion projecting outwardly of said ear plug for being directly exposed to transmitted sound waves, a housing for location in close proximity to the ear of the user and having an amplifier located therein, said amplifier and microphone being electrically interconnected for the electrical transmission of sound waves received by said microphone to said amplifier, a transducer located in said housing and being electrically connected to said amplifier, and a sound tube, one end of which extends through said plug for communication with said auditory canal and the other end of which projects into said housing for communication with said transducer, wherein the amplified sound received from said microphone is transmitted by said transducer and sound tube to the auditory canal of the user, the interior of said sound tube being free and unobstructed to provide for fidelity of sound as transferred through said sound tube to the auditory canal of the user, electrical wires interconnecting said microphone and amplifier, and a tube formed independently of said sound tube and carrying the electrical wires therein that interconnect said microphone and said amplifier.

2. A hearing aid device, comprising an ear plug for insertion into the auditory canal of the user's ear, a microphone having a body portion and sound inlet portion that projects outwardly of said body portion, the body portion of said mircophone being completely embedded in said ear plug so as to be located in said auditory canal and said sound inlet portion projecting outwardly of said ear plug for being directly exposed to transmitted sound waves, a housing for location in close proximity to the ear of the user and having an amplifier located therein, said amplifier and microphone being electrically interconnected for the electrical transmission of sound waves received by said microphone to said amplifier, a transducer located in said housing and being electrically connected to said amplifier, and a sound tube, one end of which extends through said plug for communication with said auditory canal and the other end of which projects into said housing for communication with said transducer, wherein the amplified sound received from said microphone is transmitted by said transducer and sound tube to the auditory canal of the user, the interior of said sound tube being free and unobstructed to provide for fidelity of sound as transferred through said sound tube to the auditory canal of the user, said ear plug having a recess formed therein, said microphone being received in said recess and being located in the auditory canal such that the longitudinal axis of the microphone is parallel to the longitudinal axis of said ear plug, the sound inlet portion of said microphone extending outwardly beyond the adjacent surface thereof for insuring the exposure of said microphone to sound waves, a second microphone located in said housing and having a sound inlet portion that is exposed exteriorly of said housing, wherein said second microphone complements the first-named microphone for picking up all available sound waves for amplification and transmission to the auditory canal of the user.

* * * * *